US006840650B2

(12) United States Patent
Parsons et al.

(10) Patent No.: US 6,840,650 B2
(45) Date of Patent: Jan. 11, 2005

(54) MINIATURE FLASHLIGHT HAVING REPLACEABLE BATTERY PACK

(75) Inventors: Kevin L. Parsons, Appleton, WI (US); W. Clay Reeves, Carrollton, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 37 days.

(21) Appl. No.: 10/066,554

(22) Filed: Jan. 31, 2002

(65) Prior Publication Data

US 2003/0142490 A1 Jul. 31, 2003

(51) Int. Cl.[7] ..... F21L 4/00

(52) U.S. Cl. ..... 362/196; 362/201; 362/204; 362/205

(58) Field of Search ..... 362/116, 183, 362/196, 200, 201, 204, 205, 206

(56) References Cited

U.S. PATENT DOCUMENTS

| | | | | |
|---|---|---|---|---|
| 3,899,670 A | | 8/1975 | DeHortrie | |
| 4,285,030 A | | 8/1981 | Menelly | 362/280 |
| 4,409,645 A | | 10/1983 | Sloan | 362/200 |
| 4,514,062 A | | 4/1985 | Fitzgerald | 362/205 |
| 4,535,392 A | * | 8/1985 | Montgomery | 362/186 |
| 5,457,613 A | | 10/1995 | Vandenbelt et al. | 362/200 |
| 5,730,013 A | * | 3/1998 | Huang | 362/200 |
| 5,893,631 A | * | 4/1999 | Padden | 362/201 |
| 6,045,235 A | | 4/2000 | Hee | 362/783 |
| 6,161,938 A | * | 12/2000 | Kish et al. | 362/183 |
| 6,190,018 B1 | | 2/2001 | Parsons et al. | 362/116 |
| RE37,220 E | | 6/2001 | Rapisarda et al. | 362/189 |
| 6,299,323 B1 | * | 10/2001 | Yu et al. | 362/116 |
| 6,530,672 B2 | * | 3/2003 | Galli | 362/200 |

* cited by examiner

*Primary Examiner*—John Anthony Ward
(74) *Attorney, Agent, or Firm*—Welsh & Katz, Ltd.

(57) ABSTRACT

A miniature flashlight includes a high intensity light source supported on a non-conductive battery frame that defines a recess opening outwardly of the battery frame and adapted to receive a replaceable modular self-contained power source, such as a modular battery pack. The battery frame includes a switch side plate which supports a switch slide plate for movement between an "off" position, a first position enabling momentarily closing of a circuit including the light source and battery pack, and a second circuit closing position to continuously energize the light source in response to actuation of an externally exposed switch push button. Side covers are retained on opposite sides of the battery frame and have outer exposed surfaces for receiving indicia thereon. A keyring extension is formed at one end of the battery frame and has a keyring lock that permits keys or other items to be attached to the keyring extension and also facilitates convenient attachment and detachment of the flashlight from clothing items and the like.

57 Claims, 6 Drawing Sheets

MINIATURE FLASHLIGHT HAVING REPLACEABLE BATTERY PACK

FIELD OF INVENTION

The present invention relates generally to flashlights, and more particularly to a miniature flashlight utilizing a light emitting diode ("LED") light source and a replaceable modular battery pack operative in response to switch actuation to effect momentary or continuous energizing of the LED.

BACKGROUND OF THE INVENTION

Conventional general-purpose flashlights are well known and find wide application by both law enforcement personnel and civilians. For example, flashlights are often used by law enforcement personnel during traffic stops to illuminate the interior of a stopped vehicle or to complete a police report in the dark. They are also used to facilitate searches of poorly lit areas and may be used to illuminate dark alleys or stairwells. Law enforcement personnel also use flashlights to check or adjust their equipment when positioned in a darkened area or at nighttime. Flashlights may also be used to send coded signals to one another. Thus, it is essential that law enforcement personnel carry a flashlight along with other law enforcement equipment such as a sidearm, handcuffs, and an expandable baton. With such a large number of items, it is often difficult and cumbersome for law enforcement personnel to carry all of the items on their person.

Conventional flashlights generally include an incandescent lightbulb and drycell batteries enclosed in an elongated tubular casing typically consisting of a body section and a head section. Flashlights of this type are often bulky and cumbersome. Law enforcement personnel frequently use a holster to carry a flashlight on their person. The size and weight of conventional flashlights can inhibit the mobility of law enforcement personnel when carried along with the other law enforcement equipment, and sometimes leads to the flashlight being purposely or inadvertently left behind. This presents a problem when the need for a flashlight arises and one is not readily accessible.

In addition to the use of flashlights by law enforcement personnel, civilians also use flashlights for a number of reasons. Besides the traditional home uses of flashlights, smaller flashlights are used for various security purposes. For example, when going to one's car late in the evening, it is not uncommon for an individual, especially a female, to carry a small flashlight with her. She can use the flashlight to assist in locating the keyhole in the dark. Additionally, she can use the flashlight to check whether someone is hiding in the back seat before getting into the car. Even small conventional flashlights, however, are cumbersome and inconvenient to carry for this purpose.

DESCRIPTION OF THE PRIOR ART

Although not proven particularly useful to law enforcement personnel, there exists in the prior art a small flashlight known as the Photon Micro Light. The Photon Micro Light consists of two flat, circular 3-volt batteries, a light emitting diode ("LED") and an outer shell that encloses the batteries and leads of the LED. The Micro Light uses a slide switch or pressure switch that activates the light by moving the leads of the LED into direct engagement with the batteries. The outer shell consists of two hard plastic shell halves disposed on opposite sides of the batteries and held together with threaded screws. The Micro Light has a number of disadvantages in that it lacks the durability required for a miniature flashlight, and also lacks an internal structure for protecting and securing the batteries and LED, having only the hard plastic outer shell to protect the internal components. The Micro Light may therefore be adversely affected when subjected to shock. Further, the use of screws to assemble the outer shell halves together increases the time and cost of assembly. In addition, the Micro Light has a very small keyring hole that is not well adapted for securing the flashlight to a keychain, or to otherwise readily attach and release the flashlight from one's clothing.

Another major drawback with the Micro Light is that it uses either a slide switch or pressure switch which upon activation brings both leads of the LED into direct engagement with the batteries. This results in increased fatigue on the leads of the LED and ultimately results in failure. Moreover, because of its external shape and hard plastic outer shell construction, the Micro Light is not suitable for receiving markings or engravings on the outside surfaces thereof. In many instances it is desirable to color code the exterior of the flashlight, or to provide engravings, markings, or other indicia on the exterior surface. The Micro Light is not well suited for any such color coding or desired markings or engravings.

The aforedescribed drawbacks experienced with prior conventional flashlights and the reduced size Photo Micron Light created a need for a compact, reliable and lightweight flashlight that assures long life and can be readily carried on the person of a law enforcement officer or civilian, such as being easily releasably attachable to one's clothing or a keychain to insure that the flashlight remains in possession of the user and can be quickly accessed when needed. This need has been met in large part by the miniature LED flashlight disclosed in U.S. Pat. No. 6,190,018 that is assigned to the assignee of the present invention and is incorporated herein by reference.

SUMMARY OF THE INVENTION

The subject invention is directed to a small, compact flashlight useful to both law enforcement personnel and civilians. The flashlight includes a light source, which is preferably a high intensity LED having a pair of leads extending therefrom, and a nonconductive power source frame, also termed a battery frame, having a cavity or recess opening outwardly of the battery frame and adapted to releasably receive a modular self-contained power source, such as a modular battery pack The battery frame also has a recess for receiving and at least partially enclosing the LED such that the LED leads extend into the battery frame.

The battery frame includes a switch side plate which defines a side boundary of the recess that receives the modular battery pack, and has a guide slot to receive a switch slide plate or striker. The switch slide plate is longitudinally movable between an "off" position and a first position enabling momentary closing of a circuit including the LED and battery pack so as to momentarily energize the LED in response to actuation of an externally accessible push button. Continued movement of the switch slide plate to a second position responsive to actuation of the push button closes the circuit to continuously energize the LED until the switch side plate is returned to its off position. A pair of side covers are retained on opposite sides of the battery frame by side shell members so that outer surfaces of the side covers are exposed for receiving indicia thereon.

The switch push button is received through a suitable opening in the side cover adjacent the switch side plate and is connected to the switch slide plate so as to enable an operator to actuate the push button to effect momentary or continuous interconnection of the LED to the battery pack without either lead of the LED physically contacting the battery pack. The battery frame protects the modular battery pack and positions it in precise relation to the light source and the switch slide plate. The battery frame also cushions the internal elements from the adverse affects of any shock the flashlight might be subjected to.

The battery pack power source has sufficient power to energize the LED and preferably includes a pair of circular batteries having generally flat sides, frequently referred to as coin cells. A pair of stacked long-life 3-volt batteries of the coin cell type are enclosed within a non-conductive battery holder sized to be slidingly inserted within the similar size recess in the battery frame. The battery holder and battery frame are mutually cooperable to prevent full insertion of the battery pack into the recess unless the battery holder is disposed in a predetermined orientation, thus assuring proper positioning of the positive and negative terminals of the batteries relative to the LED leads. The battery holder has a boss or pusher member thereon that extends into an opening in the battery frame so that a pusher member on a similar battery pack can be inserted into the opening from externally of the flashlight to initiate removal of a battery pack disposed within the recess.

As noted, the light source is preferably an LED that has a high luminous intensity. Manufacturers of LEDs grade the LED according to its quality. The highest quality LEDs are given an "E" grade. The next highest quality is a "D" grade. LEDs with a "D" grade can be equipped with a lens to approximate the quality of an "E" grade LED. Although the flashlight of the present invention can be used with any conventional LED, an "E" grade LED or lensed "D" grade LED is preferred. Such a high intensity LED may be obtained from Nichia Corporation Tokushima, Japan, and has from three to five times the luminous intensity of a conventional LED. The LED preferably emits blue light, although the present invention may be used with any color LED. Blue light helps to preserve a user's night vision compared with conventional flashlights emitting white light. The use of a high intensity LED as the light source provides significant advantages over conventional filament type flashlight bulbs. A LED light provides a soft general illumination as compared to the bright glare or "white out" experienced with traditional filament lamps. This is particularly important in police and security work where a police officer requires lighting, such as in a vehicle, but for security reasons does not want to use a bright light that lights up the inside of the vehicle and makes the office a "target" as experienced with traditional flashlights. Moreover, the bright light of traditional filament type flashlight makes it hard to write a report due to glare and grossly inhibits the officer's night vision. For other applications blue-green LEDs can be used, for example, in situations where compatibility with night vision equipment is desired. Other LED colors can also be used. Red LEDs can be used in applications where the preservation of night vision is desired or for use by pilots and photographers. Infrared LEDs can be used where special signaling capabilities are required or for use with equipment that senses infrared light.

As aforedescribed, the switch push button is activated by applying a thumb or finger force to the push button to move it generally longitudinally of the flashlight to close a circuit that includes the leads of the LED and the modular battery pack. The requirement that the switch push button be intentionally moved longitudinally is particularly significant. In using a flashlight that is activated, i.e., turned "on", by depressing a push button, the push button can readily be inadvertently depressed to create a flash of light. Where a police or security officer is involved in a stakeout or other covert activity, a flash of light can give away the location of the officer and subject him/her to life threatening danger. The switch push button employed in the present invention requires an intentional movement longitudinally of the flashlight and virtually eliminates unintentional or inadvertent actuation that will energize the light source.

One lead of the LED engages an electrical conductor contact that is supported by the battery frame so as to contact a negative terminal of a battery pack in the battery frame recess through an opening in the battery holder. The other LED lead is adapted to be contacted by a second electrical conductor contact that is supported by the switch side plate so that a portion of the second contact is adjacent but normally out of contact with the corresponding LED lead. The second conductor contact contacts the positive terminal of the battery pack through an opening in the battery holder and is adapted to be engaged by the switch slide plate in response to actuation of the switch push button so that the second conductor contact contacts the associated LED lead to close the circuit to the LED. In this manner, the LED leads are never flexed to make direct contact with the batteries in the battery pack. The switch slide plate or striker and the slide slot in the switch side plate have mutually cooperable detents that establish the "off", momentary light, and continuous light modes of the flashlight and enable the operator to sense or "feel" when the flashlight is in its off, momentary light, and continuous light modes. The switch arrangement thus reduces wear and possible fatigue failure of the leads of the LED, thereby increasing the life and overall reliability of the flashlight.

The battery frame may have a plurality of pegholes located about the periphery of each side to receive correspondingly positioned pegs or pins formed on the inner periphery of the side shells to facilitate attachment. The mating pegs and pegholes facilitate assembly of the flashlight by allowing the parts to be precisely aligned during assembly. It has been found that gluing the side shells to the battery frame to secure the side covers against the opposite sides of the battery frame may also provide a suitable assembly technique. Alternately, ultrasonic welding can be used to attach the non-metallic parts. Unlike the prior art, separate screws are not needed to secure the parts in assembled relation.

The side covers are fixed against opposite sides of the battery frame by the outer open side shells or frames so as to lie in substantially parallel planes and preferably have generally flat outer surfaces that are capable of receiving engravings or markings. For example, a company or individual may wish to engrave or imprint the side covers with surface indicia such as a company logo, name of a product or other promotional or advertising indicia on either or both of the side covers. A die struck medallion could also be affixed to one or both side covers. The side covers can be made of a variety of materials, such as metal, plastic, or other protective materials, but are preferably made of a suitable strength aluminum. Aluminum side panels provide additional protection to the internal components of the flashlight, can be of different contrasting colors as between themselves and between themselves and the outer periphery of the battery frame and/or open side shells, and can be easily engraved or imprinted as by laser engraving, silk screening, inking, pad printing, or other known printing or marking techniques.

The battery frame is provided with a keyring extension that is preferably formed integral with the battery frame. The keyring extension extends outwardly from an end of the battery frame opposite the LED and includes a keyring lock such that when a force is exerted against the keyring lock, the keyring extension is opened to permit keys or a keyring to be attached to the keyring extension. The keyring lock is preferably spring-biased and may be pivotally mounted on the battery frame. The keyring extension also facilitates attachment and detachment of the flashlight from any number of items, such as the zipper actuator of a coat or backpack, the handle of a purse or briefcase, a beltloop, or any other handle or case.

The flashlight of the present invention is preferably made sufficiently small, flat and compact to be readily carried in the palm of one's hand or in a pocket or purse, on the clothing, or on the keychain of law enforcement personnel or civilians. In this manner, the flashlight may be quickly and readily retrieved and operated.

One of the primary objects of the present invention to provide a flashlight that is of a small, relatively flat and compact size, is exceptionally durable and reliable, and utilizes a battery frame to support and protect a light source, preferably a high-intensity LED, a power source in the form of a replaceable modular battery pack, and a switch mechanism that is operative to close a circuit including the battery pack and LED to enable momentary or continuous energizing of the LED without the LED leads physically contacting batteries of the battery pack.

Further objects, advantages and features of the present invention will become apparent to those skilled in the art from the following detailed description of preferred embodiments when taken in conjunction with the accompanying drawings in which like reference numerals designate like elements throughout the several views.

Figure 1:
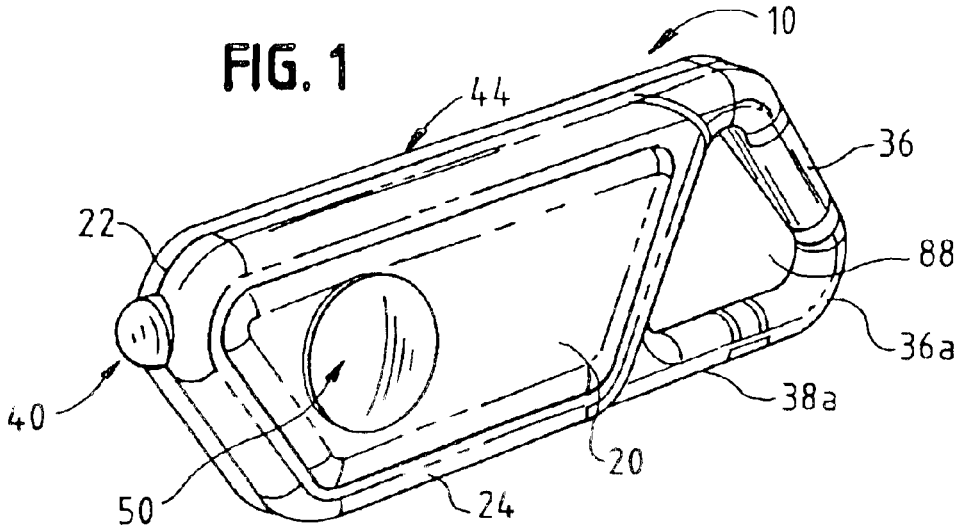
FIG. 1 is a perspective view of a flashlight constructed in accordance with the present invention.

While the present invention is susceptible of various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the invention is intended to cover all modifications, equivalents and alternatives falling within the spirit and scope of the invention.

DETAILED DESCRIPTION

Figure 2:
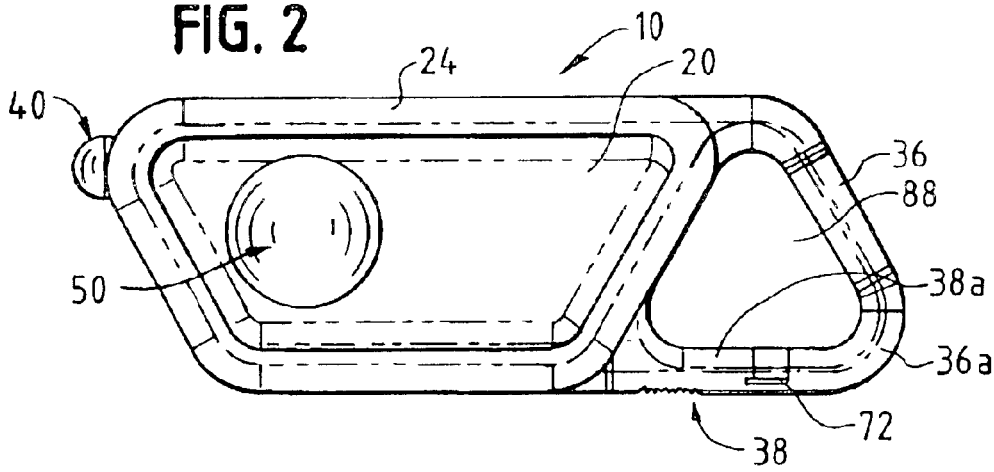
FIG. 2 is a side elevational view of the flashlight depicted in FIG. 1.
Figure 3:
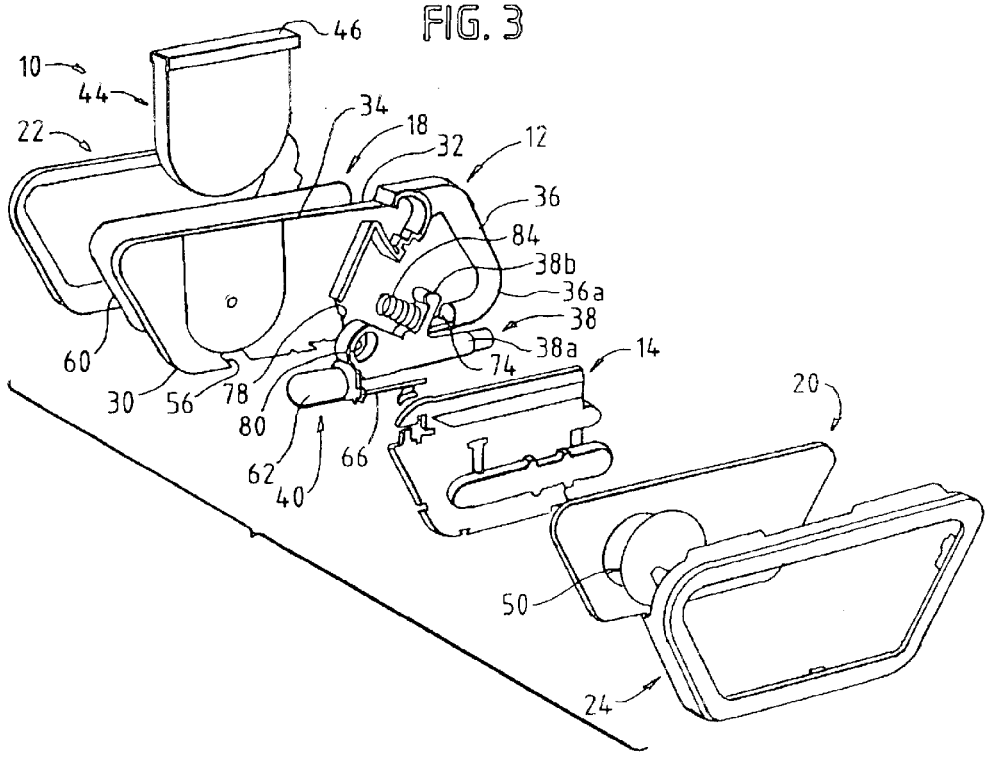
FIG. 3 is an exploded perspective view of the flashlight of FIGS. 1 & 2.

Referring now to the drawings, and in particular to FIGS. 1–3, a miniature handheld flashlight made in accordance with the present invention is indicated generally at 10. Very generally, and as illustrated in the exploded view of FIG. 3, the flashlight 10 has a housing which, in the preferred embodiment, includes a battery frame 12 that supports a high intensity light source 40 at a front end of the battery frame and to which is attached a switch side plate 14, side covers 18 and 20, and open centered side shells or frames 22 and 24 that retain the side covers against opposite sides of the battery frame. The battery frame 12 and switch side plate 14 cooperate to define a recess or chamber 30 that extends into the battery frame and opens outwardly of an edge surface 32 of the battery frame to facilitate sliding insertion of a replaceable battery pack as indicated at 44.

A keyring extension 36 is formed on an end of the battery frame 12 opposite the light source 40 and includes a keyring lock 38 that enables attachment of keys or a keychain to the keyring extension, or attachment of the flashlight to one's clothing or other item. As shown, the battery frame 12, side covers 18, 20, side shells 22, 24 and keyring extension 36 define a housing that is relatively thin or flat in edge profile and has substantially greater longitudinal length than height, as considered in FIG. 2.

As will be described, the side cover 20 is adapted to slidingly support a switch push button 50 that is exposed outwardly of the side cover 20 so as to enable one to selectively move the push button longitudinally of the battery frame to close a circuit that includes the light source 40 and the modular battery pack 44 when inserted within the recess 30. By selectively moving the push button 50 relative to the side cover 20, the light source can be energized momentarily or flashed, or can be continuously energized when a longer period of light is desired.

Figure 4:
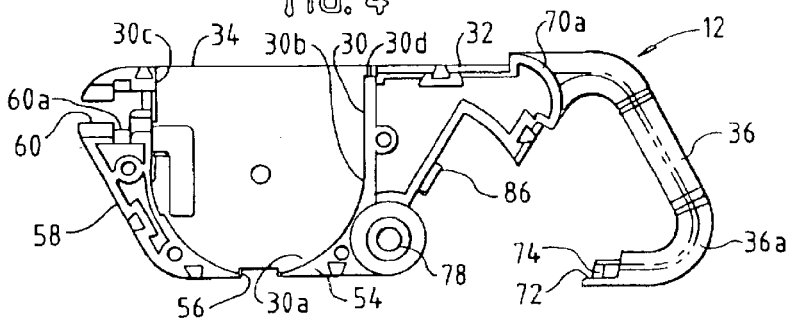
FIG. 4 is a side elevational view of one side of the power source battery frame employed in flashlight of FIG. 1.
Figure 5:
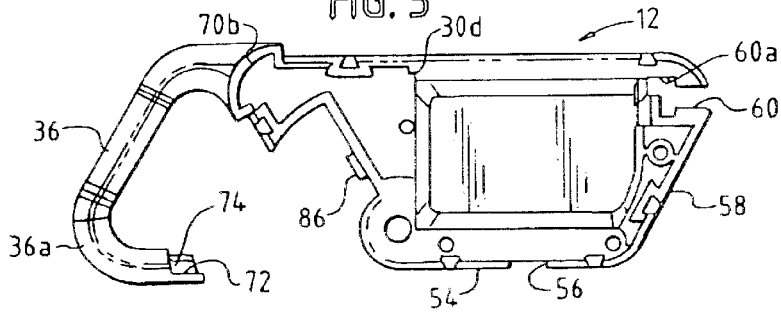
FIG. 5 is an elevational view of the opposite side of the battery frame of FIG. 4.

Turning now to a more detailed description of the various components of the flashlight 10, and referring particularly to FIGS. 4 and 5, the battery frame 12 is preferably made of a non-conductive material, such as Acrylonitrile Butadiene Styrene "ABS", which provides exceptional durability and toughness. The battery frame 12 may also be made of other non-conductive materials having suitable strength and durability characteristics. As illustrated in FIG. 4, the battery frame 12 has a first side defining a portion of the recess 30. In the illustrated embodiment, the recess 30 has a semi-circular bottom surface portion 30*a* which terminates at its upper ends in parallel rectilinear walls surfaces 30*b* and 30*c*. The lower curved wall surface 30*a* intersects a bottom or lower edge surface 54 of the battery frame to form a generally rectangular opening 56 that provides access to the recess 30. The battery frame has a front end wall surface 58 that lies in a plane inclined to the upper and lower edge surfaces 32 and 54, respectively, of the battery frame and terminates at its upper end in a recess or chamber 60 configured to receive the light source 40.

Figure 21:
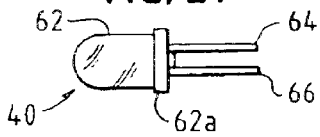
FIG. 21 illustrates an LED light source having leads extending therefrom as employed in the flashlight of FIG. 1.

As illustrated in FIG. 21, the light source 40 preferably comprises a high intensity light emitting diode ("LED") 62 having first and second leads 64 and 66. The LED 62 has an annular ring 62*a* thereon which couples with a semi-annular grove 60*a* formed in the recess 60 so as to maintain the LED in substantially fixed relation to the battery frame 12 when inserted into the recess 60. The LED light source provides significant advantages over conventional neon or incandescent filament light sources since it requires much less energy, is smaller in size, more resistant to shock, and provides a soft general illumination without "white out" or glare as experienced with traditional filament type light sources. The LED also generates significantly less heat and is more durable than a conventional light source. LED's are widely available, inexpensive, and can be readily replaced. In a preferred embodiment, the LED is a high intensity LED having a light luminous intensity emitting blue light, preferably a LED "E" grade or a lensed "D" grade.

Figure 28:
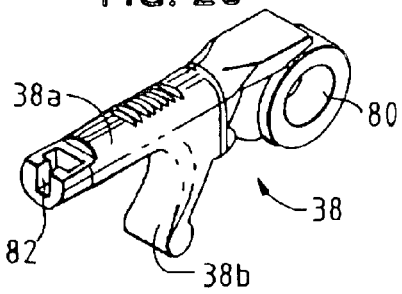
FIG. 28 is a perspective view, on an enlarged scale, of the keylock shown in FIG. 3.

Referring to FIGS. 4 and 5, taken in conjunction with FIGS. 2 and 28, the keyring extension 36 is preferably made of the same ABS material as the remainder of the battery frame 12 and is formed integral with the remainder portion. The keyring extension 36 preferably blends into the upper edge surface 32 of the battery frame and is of greater transverse width at that point so as to define arcuate edge surfaces 70*a* and 70*b* that will eventually mate with correspondingly curved surfaces on the open center side shells or frames 22 and 24 so as to form a smooth and aesthetically pleasing exterior surface of the flashlight 10. The keyring extension 36 extends from its upper end in an inclined direction generally parallel to the front end surface 58 of the battery frame. This portion of the keyring is of generally cylindrical configuration and formed with a rounded lower corner 36*a* so as to terminate in a notched end 72 having an upstanding short wall 74 of less width than the diameter of the end 36*a* of the keyring extension.

The battery frame 12 has a cylindrical boss or hub 78 formed integral thereon so as to extend transversely of the longitudinal axis of the battery frame. The boss 78 pivotally supports the keyring lock 38 through a cylindrical bore 80 (FIG. 28) in the keyring lock. As illustrated in FIG. 28, the keyring lock 38 has an arm 38*a* that lies in a plane disposed generally transverse to the axial center of the bore 80 and has a length sufficient to cause a notched end 82 of the arm 38*a* to releasably couple with the upstanding wall 74 on the notched end 72 of the keyring extension 36*a* when the keyring lock is in a closed position as shown in FIG. 2. As shown in FIG. 3, a coil compression spring 84 is interposed between a boss 86 formed on the battery frame 12 and a boss (not shown) on an arm 38*b* of the keyring lock 38 so as to bias the keyring lock into a releasable locking or engaging position with the end 72 of the keyring extension 36*a*. The keyring extension 36 and keyring lock 38 cooperate to define a generally rectangular opening 88 that readily enables keys or a keychain to be inserted into the opening 88 for connection to the keyring extension by depressing the keyring lock against the compression spring 84. The opening 88 is also sufficiently sized to enable the flashlight to be connected to one's clothing, such as over a pocket edge, through a belt loop, or through a buttonhole.

As aforedescribed, the recess 30 formed in the battery frame 12 opens outwardly from a side edge 32 of the battery frame, as shown in FIG. 3. The switch side plate 14 is adapted for mounting on the battery frame 12 to become a part of the battery frame and define a boundary surface of the recess 30 opposite a planar wall surface 30*d* shown in FIG. 4. To this end, and referring to FIGS. 13 and 14 taken in conjunction with FIG. 4, the switch slide plate 14 is made of a non-conductive material, such as a moldable polycarbonate, and has a planar surface 14*a* having a peripheral boundary substantially the same as the recess 30 formed in the battery frame 12. The switch side plate has a forward inclined edge surface 90 that terminates at its upper edge in a recess 92 that compliments the recess 60 in the battery frame 12 to complete the LED mounting chamber for the whistle when the switch side plate is mounted on the battery frame. To facilitate mounting on the battery frame, the switch side plate 14 preferably has a plurality of generally cylindrical mounting pins or pegs formed thereon, such as indicated at 96*a–d* in FIG. 13, that are inserted into correspondingly located pegholes formed in the battery frame 12. The mounting pegs and associated pegholes may couple in a friction fit or be secured by a suitable adhesive.

Figure 13:
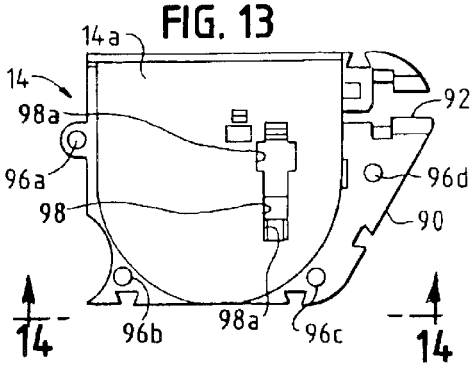
FIG. 13 shows the opposite side of the switch side plate of FIG. 12.
Figure 14:
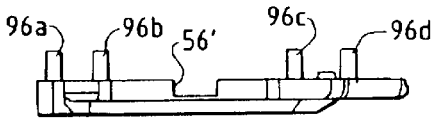
FIG. 14 is a bottom view of the switch side plate taken along the line 14—14 of FIG. 13 looking in the direction of the arrows.
Figure 15:
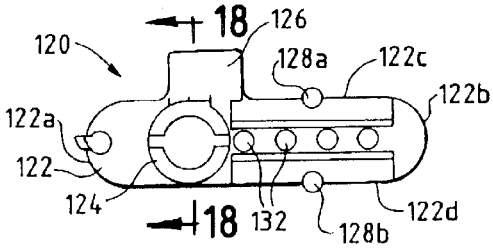
FIG. 15 is a front view of the switch plate employed with the switch side plate of FIG. 12.
Figure 16:
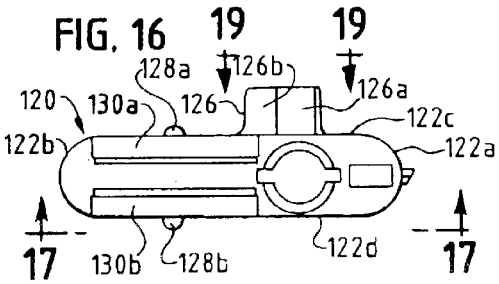
FIG. 16 illustrates the opposite side of the switch slide plate of FIG. 15.

As seen in FIG. 13, the switch side plate 14 has a recess 98 formed therein, a portion 98*a* of which extends fully through the switch side plate. The recess 98 and corresponding through-portion 98*a* are configured to facilitate mounting of a conductive contact therein which is adapted to interconnect one of the leads of the LED to a positive terminal of the battery pack without effecting physical contact of the lead with the battery, as will be described.

Figure 12:
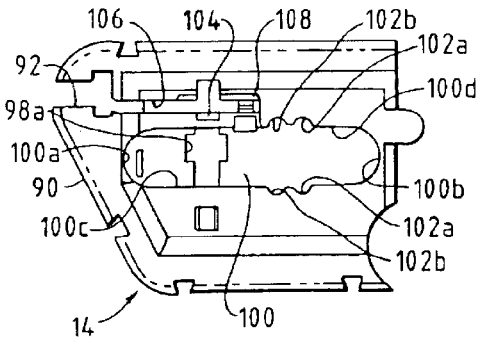
FIG. 12 is a side elevational view of the switch side plate that cooperates with the battery frame to establish the modular battery pack recess, and supports the switch slide plate shown in FIGS. 15–19.

The side of the switch side plate 14 opposite the side illustrated in FIG. 13 is shown in FIG. 12 and has an elongated slot 100 formed therein having semi-circular end surfaces 100*a* and 100*b* interconnected through rectilinear edge surfaces 100*c* and 100*d*. Two pairs of laterally opposed detent recesses, indicated at 102*a* and 102*b*, are formed in the rectilinear edges 100*c* and 100*d* and serve to establish a fist "off" position and a second "closed circuit" position for a slide switch striker plate to be described in conjunction with FIGS. 15–19.

As illustrated in FIG. 12, the portion 98*a* of the recess 98 formed in the planar surface 14*a* of the side switch plate opens into the slot 100. A grove or slot 106 is formed in the switch side plate 14 in parallel relation to the longitudinal axis of slot 100 so as to enable placement of one of the LED leads into slot 106. The slot 106 accommodates a sufficient length of the LED lead so that it extends slightly beyond the major axis of the opening 98. An opening (not shown) is preferably provided in the end wall of slot 106 to receive an end of the LED lead and thereby maintain the lead in fixed relation in slot 106.

Figure 31A:
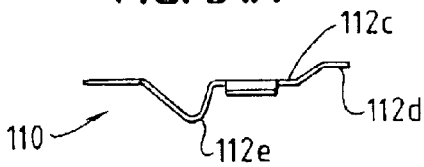
FIGS. 31A and 31B are edge and plan views, respectively, of a conductor contact for interconnecting a first lead of the LED to the battery pack.
Figure 31B:
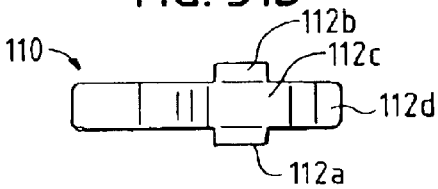
Figure 32A:
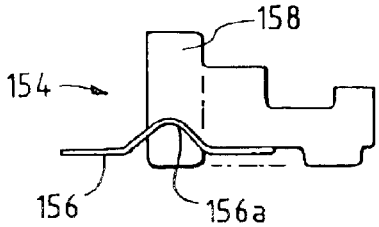
FIGS. 32A and 32B are edge and plan views, respectively, of a conductor contact for interconnecting a second lead of the LED to the battery pack.
Figure 32B:
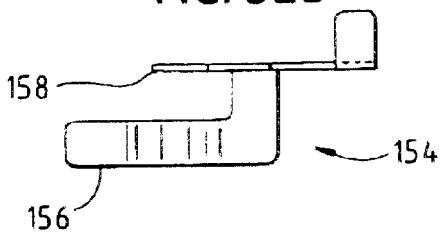

As noted, the switch side plate 14 is adapted to support a conductive contact that facilitates indirect connection of a lead of the LED to the positive terminal of the battery pack 44 when installed within the battery frame recess 30 and with the switch side plate mounted on the battery frame. Referring to FIGS. 31A and 31B, a first contact, termed the battery bottom-to-LED contact, is indicated generally at 110. The contact 110 is made from a generally thin electrically conductive metallic material 112, such as 301–302 stainless steel that is fully hardened after forming into the configuration of FIGS. 31A–B. Contact 110 has a generally rectangular plan configuration, as shown in FIG. 31B except for two laterally outwardly extending arms 112*a* and 112*b* that are inclined angularly downwardly at approximately 30° angles of incline relative to a corresponding planar portion 112*c* of the contact. The contact 110 has a lateral width sized to enable an upwardly inclined offset end tab 112*d* of the contact to be inserted through a rectangular opening 104 formed in the switch side plate 14 so that the end 112*d* is parallel to and spaced from the base of the slot 106 sufficiently to allow a LED lead to extend into the slot 106 without being intentionally contacted by the tab end 112*d* of the contact 110. With the contact 110 inserted in the slot 104, the arms 112*a* and 112*b* are received within a rectangular portion of opening 98*a* to prevent lateral movement of the contact relative to the switch side plate. The contact 110 has a V-bend portion 112*e* that is configured to engage the surface of a battery within the battery pack 44 through an opening in the battery holder when inserted into the recess 30. In this condition, the offset portion 112*d* of contact 110 is spaced from the LED in slot 106 so an open circuit condition exists between the LED light source 40 and the battery pack power source.

Figure 17:
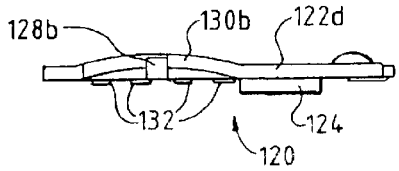
FIG. 17 is a bottom view of the switch slide plate taken along line 17—17 of FIG. 16.
Figure 18:
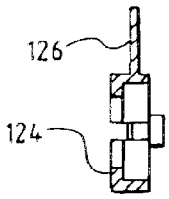
FIG. 18 is a transverse sectional view taken along line 18—18 of FIG. 15.

To effect movement of the offset contact end 112*d* of contact 110 with the LED lead disposed in the slot 106 so as to close a circuit between the LED and battery pack, a switch slide plate or striker, indicated at 120 in FIGS. 15–19, is adapted for selective longitudinal sliding within the slot 100 so as to engage the contact end 112*d* and force it into releasable contact with the LED lead. As illustrated in FIGS. 15–19, the switch slide plate or striker 120 includes a slide plate 122 having semicircular ends 122*a* and 122*b* and generally rectilinear parallel edge surfaces 122*c* and 122*d*. The switch slide plate or striker 120 is made of a suitable nonconductive material, such as polycarbonate suitable for molding, and, as shown in FIG. 17, has a transverse width or thickness generally equal to the depth of the slot or recess 100 formed in the switch side plate 14. The striker plate 122 has a longitudinal length less than the longitudinal length of the slot 100 and has a transverse height, as considered in FIGS. 18 and 19, so that the upper and lower edges 122*c* and 122*d* slidingly engage the rectilinear edge surfaces 100*c* and 100*d* of slot 100. The striker plate 122 has a generally annular boss 124 extending outwardly from an outer exposed surface of the striker plate when mounted in the slot 100. The annular boss 124 is adapted for a frictional fit with the pushbutton 50 as will be described.

Figure 19:
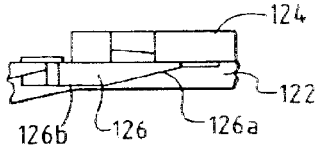
FIG. 19 is a plan view, on an enlarged scale, taken along line 19—19 of FIG. 16.

The striker plate 122 has an upstanding arm 126 formed integral therewith. The arm 126 is generally coplanar with the striker plate 122 and is adapted to slide in a slot 108 formed in the outer face of the switch side plate 14, as shown in FIG. 12, so as to overlie the slot 106 and thus the offset end 112*d* of the conductive contact 110 when inserted through the rectangular opening 104 in the switch side plate spaced from the LED lead that is disposed within the slot 106. As shown in FIG. 19, the arm 126 has an inclined cam surface 126*a* formed thereon that intersects a planar surface 126*b* on the arm 126 so that the surfaces 126*a* and 126*b* face the slot 106 when the striker plate 122 is mounted in the switch side plate recess 100. The striker plate 122 has a pair of semicircular projections 128*a* and 128*b* having centers that lie in common plane transverse to the longitudinal axis of the striker plate and are adapted to mate with the pairs of detents 102*a*, b formed in the recess 100 to establish a first position of the striker plate wherein the end 122*b* engages the end 100*b* of recess 100, and a second position with the projections 128*a, b* in detents 102*b* to establish a position wherein the planar surface 126*b* of striker plate arm 126 is in overlying relation to and engages the offset contact end 112*d* to urge it into contacting engagement with the LED lead disposed within slot 106.

The striker plate 122 is maintained in assembled relation within the recess 100 in the switch side plate 14 by the side cover 20 when mounted against the battery frame 12. To establish a relatively low friction sliding relationship of the striker plate 122 within the slot 100 while retained therein by the side cover 20, the striker plate 122 preferably has a portion of its longitudinal length formed to extend outwardly from the rear surface of the striker plate as indicated at 130*a, b* in FIG. 19. Additionally, a plurality of short length bosses are formed on the outwardly facing surface of the striker plate 122, as indicated at 132, to engage the opposing planar surface of the side cover 20 in low friction contact.

Figure 22:
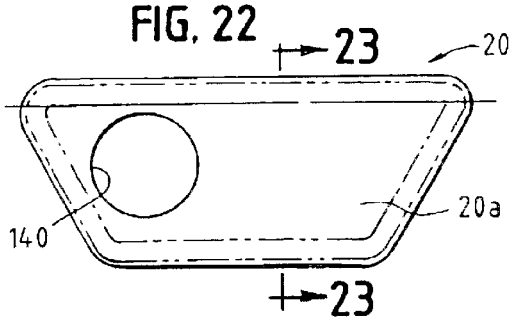
FIG. 22 is a side view of a side cover having an opening to receive the switch push button shown in FIG. 29-30.
Figure 23:
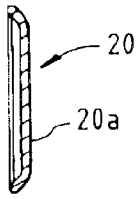
FIG. 23 is a transverse cross sectional view taken along line 23—23 of FIG. 22.
Figure 24:
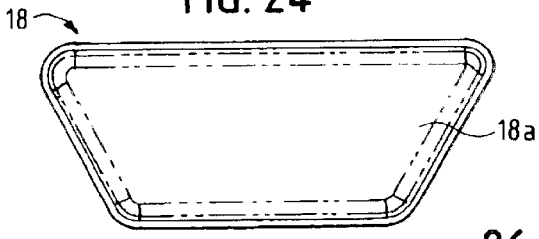
FIG. 24 is a side view of a second side cover.
Figure 25:
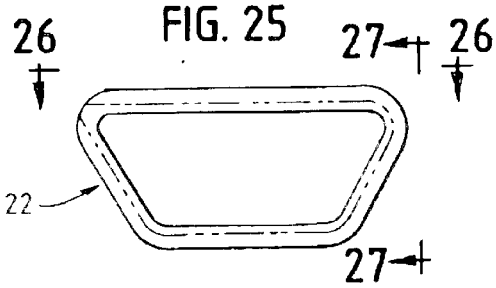
FIG. 25 is an elevational view of a side shell open frame used to retain a side cover against the battery frame.
Figure 26:
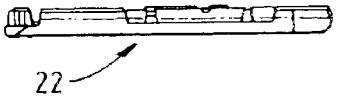
FIG. 26 is a top edge view taken along line 26—26 of FIG. 25.
Figure 27:
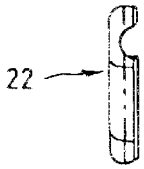
FIG. 27 is a side edge view taken along line 27—27 of FIG. 25.

FIGS. 22 and 24 are side views of the side covers 20 and 18, respectively, which are substantially mirror images of each other and are adapted to be placed against opposite sides of the battery frame 12 when having the battery frame 14 mounted thereon as aforedescribed. To this end, the outer peripheries of the side covers 18and 20 are sufficient to overlie the opposite sides of the battery frame and be secured thereagainst by the open-centered side shells or frames 22 and 24 which are substantially mirror images of each other and are adapted to be secured to the battery frame in a manner similar to the technique for attaching the housing sides 140 and 150 disclosed in U.S. Pat. No. 6,190,018 to the corresponding power source frame 22; namely, by forming pegs on the inner surfaces if the of the side shells 22 and 24 which are inserted into and retained within suitably positioned peg holes in the battery frame 12.

The side covers 18 and 20 are generally flat so as to form generally planar surface areas 18*a* and 20*a*, respectively, that preferably lie in parallel planes when assembled onto the battery frame 12 and retained thereagainst by the side shells 22 and 24. The side shells 22 and 24 substantially seal the peripheral edges of the side covers 18 and 20. The side covers 18 and 20 are made of a suitable strength material including metal, rubber, and plastic. The side covers are preferably made of aluminum, such as anodized 6061 aluminum, and their generally planar surfaces are suitable for putting indicia thereon by engraving or printing as aforedescribed.

Figure 29:
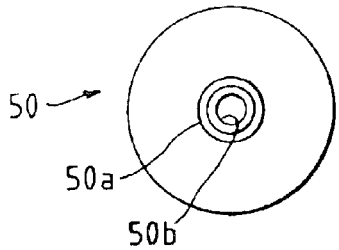
FIG. 29 is a plan view of the switch push button.
Figure 30:
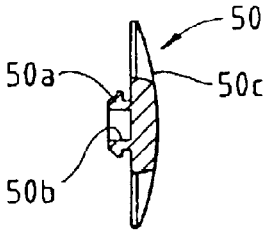
FIG. 30 is an edge view of the push button of FIG. 29, a portion being broken away for clarity.

The side cover 20 has a circular opening 140 formed therethrough and sized to receive a collar portion 50*a* of the push button 50, as shown in FIGS. 29 and 30. The opening 140 is positioned so that when the side cover 20 is mounted on the side of the battery frame 12 on which the switch side plate 14 is mounted, the opening 140 overlies and exposes the boss 124 on the switch slide plate 120. The collar 50*a* on the push button 50 has an axial bore 50*b* formed therein of a diameter to receive the annular boss 124 in a tight frictional relation sufficient to maintain the push button secured on the switch side plate. The push button 50 is made of a suitable polycarbonate and has an outer dome shaped surface 50*c* having a diameter greater then the opening 140 to enable sliding movement of the push button along the planar surface 20*a* of the side cover sufficient to effect longitudinal movement of the slide plate 120 between its off position and forward position wherein the projections 128*a, b* are disposed within the detents 102*b* in the recess 100.

Figure 6:
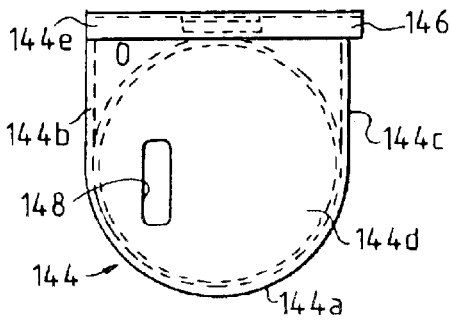
FIG. 6 is a front view of one-half of the battery holder that receives the battery of FIG. 20 to form the modular battery pack shown in FIG. 3.
Figure 7:
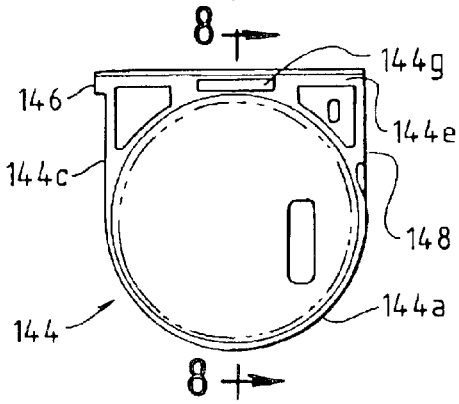
FIG. 7 shows the opposite side of the battery holder of FIG. 6.
Figure 8:
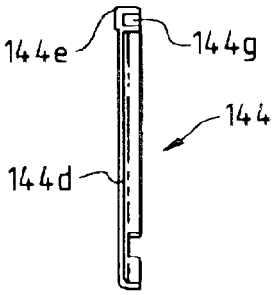
FIG. 8 is a sectional view taken along line 8—8 of FIG. 7.

FIGS. 6–8 illustrate one-half of a battery holder, indicated at 144, that is preferably made of ABS and has a semi-circular bottom end wall 144*a* that blends into parallel side walls 144*b* and 144*c* all of which are integral with a planar outer wall 144*d* of the battery holder. The sidewalls 144*b,c* and outer wall 144*d* are connected to an upper transverse rim 144*e* having an upper surface that forms one-half of the battery pack upper surface 46. The upper transverse rim 144*e* extends slightly beyond the adjacent sidewall 144*c* to define a portion of a projection 146 on the battery holder that is adapted to be received in a recess or notch 30*d* formed in the upper surface 46 of the battery frame 12, as considered in FIG.4, thereby requiring a predetermined orientation of the batter pack in order to insert it fully into the recess 30 in the battery frame.

Figure 9:
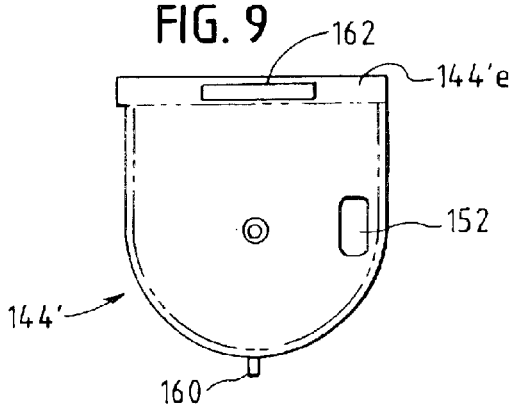
FIG. 9 is a front view of the other half of the battery holder that forms the modular battery pack.
Figure 10:
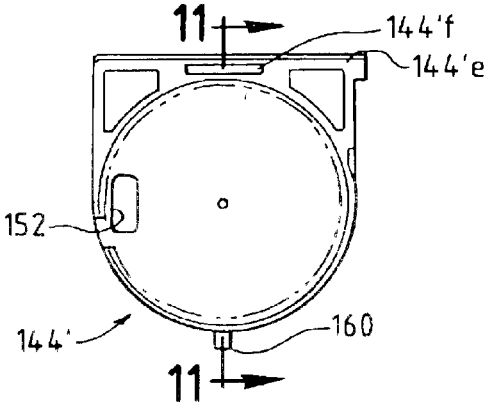
FIG. 10 shows the opposite side of the battery holder half of FIG. 9.
Figure 11:
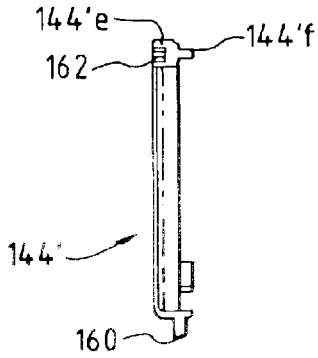
FIG. 11 is a sectional view taken along line 11—11 of FIG. 10.
Figure 20:
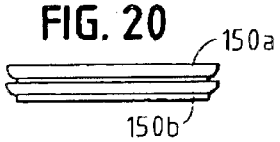
FIG. 20 is an edge view of a two-battery power source of the coin type that is enclosed within the battery holder to create the battery pack shown in FIG. 3.

FIGS. 9–11 illustrate the other half of the battery holder 44, indicated at 114'. FIG. 9 shows the outer surface of the battery holder half 144', and FIG. 10 shows the opposite inner surface. The battery holder half 144' is a substantial mirror image of the holder half 144 so that the battery holder halves can be secured together to form a holder having a circular interior chamber to receive a pair of stacked coin type batteries 150*a* and 150*b* as shown in FIG. 20. As illustrated in FIGS. 10 and 11, the battery holder half 144' has an upper transverse rim 144'*e* on which is formed an outwardly extending elongated boss 144'*f* adapted to be received in interfitting relation with a similarly shaped recess 144*g* in the upper rim 144*e* of the battery holder half 144. The planar wall 144*d* of the battery holder half 144 has a rectangular opening 148 formed therethrough which is preferably chamfered at its outer periphery in the outer exposed wall 144*d*. The rectangular opening 148 is adapted to expose the positive terminal of a pair of stacked batteries disposed within the battery holder and is positioned to receive the V-shaped portion 112*e* of the conductor contact 110 in continual contact with the positive battery terminal when the battery pack is disposed within the battery frame recess 30.

The battery holder half 144' has a rectangular opening 152 that is adapted to expose the negative terminal of the battery pack and is positioned to receive a ground conductor contact as indicated at 154 in FIGS. 31A and 31B. The contact 154 is also preferably made of 301–302 stainless steel and has a pair of flat integrally joined arm portions 156 and 158 which enable the contact 154 to be mounted in suitable groves formed in the battery frame 12 as shown in FIG.4 so that a generally V-shaped portion 156*a* projects into the opening 152 in the battery pack to constantly contact the negative battery terminal when the battery pack is inserted in the recess 30.

A cylindrical post 160 is formed on the battery pack, such as on the bottom of battery holder half 144', that can be inserted into the battery pack recess opening 56 in the battery frame 12 to partially eject a battery pack that is fully inserted into the recess. In this manner, a replacement battery pack can be used to assist in ejecting a battery pack from the battery frame to facilitate battery replacement. To further facilitate removal of a battery pack from the recess opening 56, a finger nail recess or nick 162 is preferably formed in the transverse rim portion 144'*e* of the battery holder half 144', as shown in FIG. 4. With the battery pack partially ejected, one can insert a thumb or finger nail into the recess 162 to readily remove the battery pack from the recess opening.

It can thus be seen that the flashlight in accordance with the present invention can be readily operated by intentional sliding movement of the push button 50 to move the switch slide plate 120 from its off position to a position wherein the cam surface 126*a* can effect engagement of the contact end 112*d* with the LED lead in the slot 106 to cause momentary closing of a circuit the includes the LED and the battery pack. If desired, further movement of the push button to a position wherein the projections 128*a,b* on the switch slide plate engage the detents102*b* in the recess 100 will cause the surface 126*b* on the slide plate arm 126 to continually press the contact end 112*d* against the LED lead in slot 106 to provide a continuously closed circuit to the LED until the push button is returned to its off position. This feature, coupled to the replaceable battery pack feature, presents a small flat flashlight that is a marked improvement over known flashlights.

While a preferred embodiment of the present invention has been illustrated and described, it will be understood that changes and modifications may be made therein without departing from the invention in its broader aspects. Various features of the invention are defined in the following claims.

What is claimed is:

1. A flashlight comprising a generally flat housing having substantially greater longitudinal length than thickness so as to define laterally opposite side and edge surfaces, a light source at least partially enclosed at one end of said housing, said housing having a recess opening outwardly of said housing, a modular power source adapted to be slidingly inserted into said recess, and a switch operatively associated with said housing and operative to selectively close a circuit including said light source and said power source when disposed in said recess, said housing including a battery frame defining said recess, said modular power source comprising a battery pack including a battery holder enclosing at least one battery and being mutually cooperable with said battery frame to position said battery pack in predetermined relation to said switch when said battery pack is inserted into said recess and said battery frame including a switch plate having a first surface defining a side boundary of said recess, said switch plate having a second opposite surface defining a guide slot, a switch slide plate being disposed within said guide slot and movable to a first position enabling momentary closing of said circuit to energize said light source, said switch slide plate being movable to a second position enabling continuous closing of said circuit, said switch including a push button exposed externally of said housing and cooperative with said slide plate to enable an operator to move said slide plate between said first and second positions.

2. A flashlight as defined in claim 1 wherein said switch plate and said switch slide plate are mutually cooperable to establish an off position for said switch slide plate wherein said circuit is open, said push button being operative to move said slide plate to said first position from said off position in response to predetermined movement of said push button longitudinally of said housing, and being operative to effect movement of said slide plate to said second position in response to continued movement of said push button longitudinally of said housing from said off position.

3. A flashlight as defined in claim 1 wherein said switch plate and said slide plate define mutually cooperable detents operative to releasably maintain said slide plate in either said off or second positions in response to actuation of said push button by an operator.

4. A flashlight comprising a generally flat housing having substantially greater longitudinal length than thickness so as to define laterally opposite side and edge surfaces, a light source at least partially enclosed at one end of said housing, said housing having a recess opening outwardly of said housing, a modular power source adapted to be slidingly inserted into said recess, and a switch operatively associated with said housing and operative to selectively close a circuit including said light source and said power source when disposed in said recess, said housing including a battery frame defining said recess, said modular power source comprising a battery pack including a battery holder enclosing at least one battery and being mutually cooperable with said battery frame to position said battery pack in predetermined relation to said switch when said battery pack is inserted into said recess and a selected one of said battery holder and housing recess having a detent notch or opening to said recess thereon or therein cooperative with a post formed on the other of said battery holder and housing so as to releasably retain said battery holder within said recess.

5. A flashlight comprising a generally flat housing having substantially greater longitudinal length than thickness so as to define laterally opposite side and edge surfaces, a light source at least partially enclosed at one end of said housing, said housing having a recess opening outwardly of said housing, a modular power source adapted to be slidingly inserted into said recess, and switch operatively associated with said housing and operative to selectively close a circuit including said light source and said power source when disposed in said recess, said housing including a battery frame defining said recess, said modular power source comprising a battery pack including a battery holder enclosing at least one battery and being mutually cooperable with said battery frame to position said battery pack in predetermined relation to said switch when said battery pack is inserted into said recess and said housing including a pair of side covers retained against opposite sides of said battery frame by corresponding frame members, said frame members engaging only the periphery of the corresponding side covers so as to expose outwardly facing surfaces of said side covers.

6. A flashlight as defined in claim 5 wherein said battery frame, switch plate, battery holder and frame members are made of a non-metallic material, said side covers being made of different material.

7. A flashlight as defined in claim 6 wherein said non-metallic material comprises plastic, and said different material comprises aluminum.

8. A flashlight comprising, in combination;

a light source, a modular power source, a housing at least partially enclosing said light source, having opposite side surfaces, having an outer peripheral edge surface, having a recess in said housing extending to said peripheral edge surface and opening in said peripheral edge surface and communicating with said recess for slidingly receiving said power source therethrough for positioning said power source in said recess in predetermined relation to said light source and a switch operatively associated with said housing and adapted to close a circuit including said light source and said modular power source so as to energize said light source, said switch being selectively operable in a first mode to momentarily close said circuit, and being selectively operable in a second mode to continuously close said circuit.

9. A flashlight as defined in claim 8 wherein said switch includes a push button carried by said housing, said push button being movable generally longitudinally of said housing to a first position to effect operation of said switch in said first mode, and being movable generally longitudinally of said housing to a second position to effect operation of said switch in said second mode.

10. A flashlight as defined in claim 9 wherein said push button includes an outer dome surface extending outwardly of said housing to facilitate actuation of said push button by an operator's thumb or finger.

11. A flashlight as defined in claim 8 wherein said modular power source comprises a modular battery pack including a battery holder enclosing at least one battery so as to prevent inadvertent release of said battery from said holder, said holder having a first opening enabling access to a positive pole of said battery, and having a second opening enabling access to a negative pole of said battery.

12. A flashlight as defined in claim 11 wherein said light source comprises a LED having leads extending therefrom, said housing including a battery frame defining said recess and supporting said LED with said leads extending into said battery frame, a selected one of said leads being interconnected to said negative pole of said battery without physically contacting said negative pole, the other of said leads being adapted for interconnection to said positive pole without physically contacting said positive pole in response to operation of said switch in said first and second modes.

13. A flashlight as defined in claim 8 wherein said modular power source comprises a modular battery pack including a battery holder enclosing at least one battery.

14. A flashlight as defined in claim 13 wherein said battery holder and said housing are mutually cooperable to prevent full insertion of said battery pack into said recess unless said battery pack is in a predetermined orientation relative to said housing when inserted into said recess.

15. A flashlight as defined in claim 13 wherein said battery holder has a generally planar surface disposed in substantially coplanar relation with an external surface of said housing adjacent said recess when said battery pack is fully inserted into said recess.

16. A flashlight as defined in claim 13 wherein said battery holder has a locating arm adapted for receipt within a notch formed in said housing adjacent said recess when said battery pack is inserted into said recess disposed in said predetermined orientation.

17. A flashlight as defined in claim 8 wherein said housing includes a second opening in said peripheral edge surface located generally opposite said first named opening and communicating with said recess so as to enable insertion of a pusher member into said second opening to at least partially eject said modular power source from said recess when disposed therein.

18. The flashlight as defined in claim 8 wherein the switch is a slide-type switch.

19. A flashlight comprising, in combination;

a light source, a modular power source, a housing at least partially enclosing said light source, having a recess therein, having a peripheral edge surface and having a first opening in said peripheral edge surface communicating with said recess for slidingly receiving said modular power source through said first opening and into said recess for being positioned in predetermined relation to said light source, and a switch operatively associated with said housing and adapted to close a circuit including said light source and said modular power source so as to energize said light source, said switch being selectively operable in a first mode to momentarily close said circuit, and being selectively operable in a second mode to continuously close said circuit, said housing having a second opening located generally opposite said first opening and communicating with said recess so as to enable insertion of a pusher member into said second opening to at least partially eject said modular power source from said recess when disposed therein and said modular power source having a post extending therefrom positioned to enter said second opening when said modular power source is fully inserted into said recess, whereby a post on a similarly shaped modular power source can be inserted into said opening from externally of said housing to at least partially eject a modular power source when fully disposed within said recess.

20. A flashlight comprising, in combination;

a light source, a modular power source, a housing at least partially enclosing said light source and having a recess opening externally of said housing for slidingly receiving said power source in predetermined relation to said light source, and a switch operatively associated with said housing and adapted to close a circuit including said light source and said modular power source so as to energize said light source, said switch being selectively operable in a first mode to momentarily close said circuit, and being selectively operable in a second mode to continuously close said circuit and said housing including a battery frame having a switch plate having a first surface defining a side boundary of said recess, said switch plate having a second opposite surface defining a guide slot, a switch slide plate disposed within said guide slot and movable to a first position enabling momentary closing of said circuit to energize said light source, said switch slide plate being movable to a second position enabling continuous closing of said circuit, said switch including a push button exposed externally of said housing and cooperative with said slide plate to enable an operator to move said slide plate between said first and second positions.

21. A flashlight as defined in claim 20 wherein said switch plate and said switch slide plate are mutually cooperable to establish an off position for said switch slide plate wherein said circuit is open, said push button being operative to move said slide plate to said first position from said off position in response to predetermined movement of said push button longitudinally of said housing, and being operative to effect movement of said slide plate to said second position in response to continued movement of said push button longitudinally of said housing from said off position.

22. A flashlight as defined in claim 20 wherein said switch plate and said slide plate define mutually cooperable detents operative to releasably maintain said slide plate in either said off or second positions in response to actuation of said push button by an operator.

23. A flashlight comprising, in combination; a light source, a modular power source, a housing at least partially enclosing said light source and having opposite side surfaces and an outer peripheral edge surface and having a recess extending into said housing from said peripheral edge surface and opening externally of said housing on said peripheral edge surface for slidingly receiving said power source in predetermined relation to said light source, a switch operatively associated with said housing and adapted to close a circuit including said light source and said modular power source so as to energize said light source, said switch being selectively operable in a first mode to momentarily close said circuit, and being selectively operable in a second mode to continuously close said circuit, and said light source comprising a LED having a pair of leads extending internally of said housing, one of said leads being interconnected to a negative terminal of said battery pack when disposed in said recess, said switch being operative to interconnect the other of said leads in circuit with the positive terminal of said modular power source without effecting physical contact of said other lead with a positive terminal.

24. A flashlight comprising a generally flat housing having a substantially greater longitudinal length than thickness so as to define laterally opposite generally flat side surfaces and an outer peripheral edge surface which is generally normal to said side surfaces and which extends about a periphery of said housing, a light source at least partially enclosed at one end of said housing, said housing having a recess which includes an opening that opens outwardly of and onto said housing peripheral edge surface, a modular, generally flat, power source adapted to be slidingly inserted through said opening in said peripheral edge surface and into said recess, and a switch operatively associated with said housing and operative to selectively close a circuit including said light source and said power source when disposed in said recess.

25. A flashlight as defined in claim 24 including a keying extending outwardly from said housing and defining an opening to enable attachment of keys or a key chain to said keying, or enable attachment of the flashlight to support means.

26. A flashlight as defined in claim 25 wherein said keying includes a keying lock operative to prevent unintentional release of keys or a key chain from said keying.

27. A flashlight as defined in claim 25 wherein said keying extends longitudinally outwardly from an end of said housing opposite said light source.

28. A flashlight as defined in claim 24 wherein said housing includes a battery frame defining said recess, said modular power source comprising a battery pack including a battery holder enclosing at least one battery and being mutually cooperable with said battery frame to position said battery pack in predetermined relation to said switch when said battery pack is inserted into said recess.

29. A flashlight as defined in claim 28 wherein said battery holder has a pair of openings therein facilitating electrical connection of positive and negative terminals of said battery in circuit with said light source.

30. A flashlight as defined in claim 29 wherein said light source comprises an LED having a pair of leads extending internally of said housing, one of said leads being interconnected to a negative terminal of said battery pack when disposed in said recess, said switch being operative to interconnect the other of said leads in circuit with the positive terminal of said battery pack without effecting physical contact of said other lead with said positive terminal.

31. A flashlight as defined in claim 28 wherein said battery holder and said battery frame are mutually co-operable to prevent full insertion of said battery pack into said recess unless said battery pack is in a predetermined orientation relative to said battery frame when inserted into said recess.

32. A flashlight as defined in claim 28 wherein said battery frame has an opening communicating with said recess so as to enable insertion of a pusher member into said opening in said battery frame to at least partially eject said battery pack from said recess.

33. A flashlight as defined in claim 32 wherein said battery holder has a post extending therefrom positioned to enter said opening in said battery frame when said battery pack is fully inserted into said recess, whereby a battery holder post on a similarly shaped battery holder can be inserted into said opening in said battery frame from externally of said battery frame to at least partially eject a battery pack when fully disposed within said recess.

34. A flashlight as defined in claim 28 wherein said battery holder has a generally planar surface disposed in substantially coplanar relation with said one of said edge surfaces when said battery pack is fully inserted into said recess.

35. A flashlight as defined in claim 28 wherein said battery holder has a locating arm adapted for receipt within a notch formed in said battery frame adjacent said recess when said battery pack is inserted into said recess disposed in said predetermined orientation.

36. The flashlight as defined in claim 24 wherein the switch is a slide-type switch.

37. A flashlight comprising, in combination;

a light source, a modular power source, a housing at least partially enclosing said light source, having a peripheral edge surface, having a recess therein and having an opening in said peripheral edge surface communicating with said recess for slidingly receiving said power source through said opening and into said recess for positioning said power supply in predetermined relation to said light source, and a switch operatively associated with said housing and adapted to close a circuit including said light source and said modular power source so as to energize said light source, said switch being selectively operable in a first mode to momentarily close said circuit, and being selectively operable in a second mode to continuously close said circuit and said switch including a push button carried by said housing, said push button being movable from an off position to a first position to effect operation of said switch in said first mode, and being movable to a second position to effect operation of said switch in said second mode.

38. A flashlight as defined in claim 37 wherein said push button includes an outer surface extending outwardly of said housing to facilitate actuation of said push button by a operator's thumb or finger.

39. A flashlight as defined in claim 38 wherein said modular power source comprises a modular battery pack including a battery holder enclosing at least on battery so as to prevent inadvertent release of said battery from said holder, said holder having a first opening enabling access to a positive pole of said battery, and having a second opening enabling access to a negative pole of said battery.

40. A flashlight as defined in claim 37 wherein said modular power source comprises a modular battery pack including a battery holder enclosing at least one battery.

41. A flashlight as defined in claim 40 wherein said battery holder and said housing are mutually cooperable to prevent full insertion of said battery pack into said recess unless said battery pack is in a predetermined orientation relative to said housing when inserted into said recess.

42. A flashlight as defined in claim 41 wherein said housing has a second opening located generally opposite said first opening and communicating with said recess so as to enable insertion of a pusher member into said second opening to at least partially eject said battery pack from said recess when disposed therein.

43. A flashlight comprising a generally flat housing having substantially greater longitudinal length than thickness so as to define laterally opposite side and edge surfaces, a light source at least partially enclosed at one end of said housing, said housing having a first opening in said edge surface, a recess in said housing communicating with said first opening, a modular power source adapted to be slidingly inserted through said first opening and into said recess, a switch operatively associated with said housing and operative to selectively close a circuit including said light source and said power source when disposed in said recess and said housing having a second opening in said edge surface, located generally opposite said first opening and communicating with said recess so as to enable insertion of a pusher member into said second opening to at least partially eject said power source from said recess.

44. A flashlight as defined in claim 43 wherein said modular power source has a post extending therefrom positioned to enter said opening when said power source is fully inserted into said recess, whereby a post on a similarly shaped power source can be inserted into said opening from externally of said housing to at least partially eject a power source when fully disposed within said recess.

45. A flashlight as defined in claim 43 wherein said housing has a notch adjacent said recess and said modular power source has a locating arm adapted for receipt within said notch when said modular power source is inserted into said recess to locate said modular power source in a predetermined orientation in said housing and with the correct polarity with respect to lead connection to said light source.

46. A flashlight comprising a generally flat housing having substantially greater longitudinal length than thickness so as to define laterally opposite side and edge surfaces, a light source at least partially enclosed at one end of said housing, said housing having a recess opening outwardly of said housing, a modular power source adapted to be slidingly inserted into said recess, a switch operatively associated with said housing and operative to selectively close a circuit including said light source and said power source when disposed in said recess, said modular power source comprises a modular battery pack including a battery holder enclosing at least one battery and said battery holder having a nail nick or notch formed therein to facilitate insertion of a thumb or finger nail for removing the battery holder from the recess.

47. A battery pack for use with a flashlight that includes a housing having opposite side surfaces and an outer peripheral edge surface and having a recess of predetermined, generally flat configuration opening outwardly of the housing peripheral edge surface for receiving a battery pack, said battery pack comprising a generally flat battery holder having generally parallel opposite external walls defining a generally flat cavity therebetween adapted to enclose at least one coin type battery having side surfaces of opposite polarity, said battery holder being configured generally flat to enable insertion into the recess through said peripheral edge surface, said external walls each having an opening therein enabling access to the opposite polarity sides of the battery.

48. The battery pack as defined in claim 47 wherein said battery holder includes means for limiting insertion of the holder into the flashlight recess unless the holder is inserted into the recess when disposed in a predetermined orientation relative to the flashlight recess.

49. The battery pack as defined in claim 48 wherein said means for limiting insertion of the battery holder into the flashlight recess comprises a rectilinear rim formed on said battery holder and defining an extension adapted to prevent full insertion of the holder into the recess unless the holder is disposed in said predetermined orientation.

50. The battery pack as defined in claim 47 wherein the flashlight has an opening communicating with said recess and wherein the battery holder has an external boss adapted to be received in said opening communicating with said recess when the battery pack is fully inserted into the recess.

51. The battery pack as defined in claim 47 wherein the battery holder has a nail notch formed therein to enable insertion of a user's thumb or finger nail to facilitate removal of the battery pack from the flashlight recess when disposed therein.

52. A battery pack for use with a flashlight that includes a housing having a recess of predetermined configuration opening outwardly of the housing for receiving a battery pack, said battery pack comprising a battery holder having generally parallel opposite external walls defining a cavity therebetween adapted to enclose at least one coin type battery having side surfaces of opposite polarity, said battery holder being configured to enable insertion into the flashlight recess, said external walls each having an opening therein enabling access to the opposite polarity sides of the battery and the flashlight housing having an external opening communicating with the recess therein, said battery holder having a post extending therefrom positioned to enter the opening when the battery pack is fully inserted into the flashlight recess, whereby a post on a similarly shaped battery holder can be inserted into the opening from externally of the housing to at least partially eject a battery pack when disposed within said recess.

53. The battery pack as defined in claim 52 wherein said battery holder has a locating arm adapted for receipt within a notch formed in the flashlight housing adjacent the recess when the battery pack is disposed in a predetermined orientation.

54. A flashlight comprising a generally flat housing having laterally opposite side surfaces and an outer peripheral edge surface, a light source at least partially enclosed at one end of said housing, said housing having a recess opening outwardly of said housing peripheral edge surface, a modular, generally flat, power source adapted to be slidingly inserted into said recess opening onto said peripheral edge surface, and a switch operatively associated with said housing and operative to selectively close a circuit including said light source and said power source when disposed in said recess, said housing including a battery frame defining said recess, said modular power source comprising a battery pack including a battery holder enclosing at least one battery and being mutually co-operable with said battery frame to position said battery pack in predetermined relation to said switch when said battery pack is inserted into said recess so that said at least one battery has the proper polarity with respect to lead connections to said light source.

55. A flashlight as defined in claim 54 wherein said battery frame has a notch adjacent said recess and said battery holder has a locating arm adapted for receipt within said notch when said battery pack is inserted into said recess to locate the at least one battery in a predetermined orientation in said battery frame and with the correct polarity with respect to said lead connections to said light source.

56. A battery pack for use with a flashlight that includes a housing having a recess of predetermined configuration opening outwardly of the housing for receiving a battery pack, said battery pack comprising a battery holder having generally parallel opposite external walls defining a cavity therebetween adapted to enclose at least one coin type battery having side surfaces of opposite polarity, said battery holder being configured to enable insertion into the flashlight recess, said external walls each having an opening therein enabling access to the opposite polarity sides of the battery and the flashlight housing having an external opening communicating with the recess therein, said battery holder having a post extending therefrom positioned to enter the opening when the battery pack is fully inserted into the flashlight recess, whereby a post on a similarly shaped battery holder can be inserted into the opening from externally of said battery holder and said battery holder having a nail nick or notch formed therein to facilitate insertion of a thumb or finger nail for removing the battery holder from the recess when the battery holder is partially ejected from the recess by the insertion of said post into the recess.

57. The battery pack of claim 56 for use with the flashlight that includes the housing having a recess and which housing has a notch adjacent the recess and wherein said battery pack has a locating arm adapted for receipt within the notch when said battery pack is inserted into the recess to locate the at least one battery predetermined orientation in said battery holder to establish the correct polarity of the at least one battery with respect to the lead connections to the light source.

* * * * *